US006006667A

United States Patent [19]

Lewis

[11] Patent Number: 6,006,667

[45] Date of Patent: Dec. 28, 1999

[54] METHOD OF LITHOGRAPHIC IMAGING WITH REDUCED DEBRIS-GENERATED PERFORMANCE DEGRADATION AND RELATED CONSTRUCTIONS

[75] Inventor: Thomas E. Lewis, East Hampstead, N.H.

[73] Assignee: Presstek, Inc., Hudson, N.H.

[21] Appl. No.: 09/041,548

[22] Filed: Mar. 12, 1998

[51] Int. Cl.[6] ..... B41N 1/14

[52] U.S. Cl. ..... 101/462; 101/467

[58] Field of Search ..... 101/453, 454, 101/457, 462, 467; 430/302, 303

[56] References Cited

U.S. PATENT DOCUMENTS

| | | | |
|---|---|---|---|
| 3,776,888 | 12/1973 | Mattor | 430/302 |
| 4,088,489 | 5/1978 | Rubner et al. | 430/322 |
| 4,332,882 | 6/1982 | Ahne et al. | 430/322 |
| 5,098,971 | 3/1992 | Nagai et al. | 526/247 |
| 5,410,069 | 4/1995 | Nishimura et al. | 548/547 |
| 5,440,446 | 8/1995 | Shaw et al. | 361/301.5 |
| 5,569,573 | 10/1996 | Takahashi et al. | 101/453 |
| 5,570,636 | 11/1996 | Lewis | 101/467 |
| 5,638,753 | 6/1997 | Lewis et al. | 101/454 |
| 5,783,364 | 7/1998 | Ellis et al. | 101/467 |

FOREIGN PATENT DOCUMENTS

| | | | |
|---|---|---|---|
| 1050805 | 3/1979 | Canada | 101/467 |
| 0755781A1 | 1/1997 | European Pat. Off. . | |
| 0802067A1 | 10/1997 | European Pat. Off. . | |
| 0825021A2 | 2/1998 | European Pat. Off. . | |
| WO93/09957 | 5/1993 | WIPO . | |

*Primary Examiner*—Stephen R. Funk
*Attorney, Agent, or Firm*—Cesari and McKenna, LLP

[57] ABSTRACT

The performance-limiting effects of thermal breakdown on ablation-type lithographic printing plates are overcome by rendering the ink-accepting surface largely impervious to the effects of debris originating with the surface layer of the printing member, or by discouraging the formation of harmful debris altogether. In one approach, the ink-accepting surface is a highly crosslinked polymer. The resulting cured matrix exhibits a sufficient degree of three-dimensional bonding to resist melting, softening, or chemical degradation as a result of the imaging process. Alternatively, an intervening layer, disposed between the imaging layer and the surface layer, prevents the surface layer from undergoing significant thermal degradation in response to imaging radiation or ablation of the underlying imaging layer, and is also formulated to produce little debris or debris having an affinity for ink and/or fountain solution similar to the affinity of the substrate—e.g., which does not reduce the oleophilicity of the underlying ink-accepting surface. Following imaging, the remnants of the insulating layer are removed along with the surface layer where the plate received imaging radiation.

15 Claims, 2 Drawing Sheets

METHOD OF LITHOGRAPHIC IMAGING WITH REDUCED DEBRIS-GENERATED PERFORMANCE DEGRADATION AND RELATED CONSTRUCTIONS

BACKGROUND OF THE INVENTION

1. Field of the Invention

The present invention relates to digital printing apparatus and methods, and more particularly to imaging of lithographic printing-plate constructions on- or off-press using digitally controlled laser output.

2. Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-abhesive fountain solution prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers. For example, U.S. Pat. Nos. 5,351,617 and 5,385,092 (the entire disclosures of which are hereby incorporated by reference) describe an ablative recording system that uses low-power laser discharges to remove, in an imagewise pattern, one or more layers of a lithographic printing blank, thereby creating a ready-to-ink printing member without the need for photographic development. In accordance with those systems, laser output is guided from the diode to the printing surface and focused onto that surface (or, desirably, onto the layer most susceptible to laser ablation, which will generally lie beneath the surface layer).

U.S. Pat. Nos. 5,807,658; 5,783,364; 5,339,737; and Re. U.S. Pat. No. 35,512, the entire disclosures of which are hereby incorporated by reference, describe a variety of lithographic plate configurations for use with such imaging apparatus. In general, the plate constructions may include a first, topmost layer chosen for its affinity for (or repulsion of) ink or an ink-abhesive fluid. Underlying the first layer is an image layer, which ablates in response to imaging (e.g., infrared, or "IR") radiation. A strong, durable substrate underlies the image layer, and is characterized by an affinity for (or repulsion of) ink or an ink-abhesive fluid opposite to that of the first layer. Ablation of the absorbing second layer by an imaging pulse generally weakens the topmost layer as well. By disrupting its anchorage to an underlying layer, the topmost layer is rendered easily removable in a post-imaging cleaning step. This creates an image spot having an affinity for ink or an ink-abhesive fluid differing from that of the unexposed first layer, the pattern of such spots forming a lithographic plate image.

Depending on the particular printing member and imaging conditions, certain performance limitations may be observed. For example, a silicone-surfaced dry plate may exhibit insufficient retention of ink by the exposed ink-receptive (generally polyester) layer. The source of this behavior, however, is complex; it does not arise merely from stubbornly adherent silicone fragments. Simple mechanical rubbing of the silicone layer, for example, reliably removes from the ink-accepting layer all debris visible even under magnification, and well before damage to the unimaged silicone areas might occur. Nonetheless, such plates still may print with the inferior quality associated with inadequate affinity for ink. And while ink acceptance is substantially improved through cleaning with a solvent, this process can soften the silicone as well as degrade its anchorage to unimaged portions of the plate. Solvents also raise environmental, health and safety concerns.

Study of the imaging process and its effect on certain types of plate constructions, particularly those containing thin-metal ablation layers below silicone top coatings, suggests that the observed printing deficiencies arise from subtle chemical and morphological changes induced by the imaging process. Plates based on thin-metal imaging layers require heating to substantially higher temperatures to undergo ablation than, for example, laser-imageable printing plates having self-oxidizing (e.g., nitrocellulose) ablation layers. Particularly when low-power imaging sources are used, the exposure time necessary for catastrophic heat buildup can be significant, affording opportunity for unwanted thermal reactions. For example, the low-power imaging pulse of a diode laser must persist for a minimum duration (usually 5–15 $\mu$sec) in order to heat a metal such as titanium beyond its melting point of 1680° C. Because the titanium layer is in contact with the chemically complex silicone layer, these high temperatures can induce reactions that produce silicone-derived products of thermal degradation. The breakdown products combine both chemically and mechanically, and with the titanium layer volatilized, are free to interact with the underlying ink-receptive film surface. That surface, moreover, is also rendered more vulnerable to interaction with silicone breakdown products as a result of exposure to high temperatures, which can melt and thermally degrade the surface of the film so that it readily accepts silicone breakdown products. The adhesion, implantation, mechanical intermixture, and chemical reaction of these breakdown products with the film interferes with its ability to retain ink.

These effects can be better appreciated through more detailed analysis of the imaging process. The intense and protracted local heating of the metal layer required to achieve the necessary ablation temperatures exerts a variety of physical effects on the surrounding internal plate structures. Before the metal layer undergoes any change, a bubble forms, lifting the silicone layer. This bubble most likely arises from gaseous, homolytic decomposition of the silicone layer at the interior interface with the rapidly heating metal layer.

Subsequently, a hole forms in the metal layer, beginning in the center of the exposed spot and expanding outwardly, as a bead of molten metal, until it reaches the rim of the exposed is area. After the imaging pulse terminates, the previously lifted silicone settles back. This delay results from the persistence of heat in the silicone and exposed ink-accepting layers due to the relatively low heat-transport rates that characterize polymeric materials. The underlying film also undergoes considerable thermally induced physical changes. The effect of intense heating is typically to impart a porous, three-dimensional texture to the surface of the ink-receptive film exposed by imaging.

The surface energy of the exposed film is much lower than that of the unmodified material. In the case of polyester, for example, surface energies of approximately 25 dynes/cm are observed following dry cleaning, as compared with about 40 dynes/cm in the unmodified material. The observed change in surface energy likely derives from the presence of silicone byproducts mixing with the thermally altered film surface. These byproducts build up over the heat-textured polyester surface, effectively masking that surface. And because the combinations involve chemical as well as mechanical bonds, simple abrasion cleaning is insufficient to dislodge the low-surface-energy silicone. These effects interfere with the resulting plate's acceptance of ink. Low surface energy renders a compound such as silicone abhesive to ink; accordingly, reduction in the surface energy of an oleophilic material will diminish its affinity for ink.

DESCRIPTION OF THE INVENTION

Brief Summary of the Invention

In a first aspect, the present invention counteracts the performance-limiting effects of thermal breakdown by rendering the ink-accepting surface largely impervious to the effects of debris originating with the surface layer of the printing member. As used herein, the term "debris" is intended to connote thermally generated breakdown products, which may arise from chemical mechanisms such as homolysis or mechanical processes such as shear or tearing, and which may range in size from the molecular level to bulk (although microscopic) fragments.

In accordance with this aspect of the invention, the ink-accepting surface may be a highly crosslinked polymer. The term "highly crosslinked" is used to connote a polymer having a three-dimensional network of covalent bonds and exhibiting very high cohesive energy densities. Such materials are typically obtained by curing (e.g., by exposure to actinic radiation or an electron-beam source) a polyfunctional monomer, each molecule of which is capable of establishing multiple covalent bonds with the same or other chemical species present in the reaction mixture. It is, however, also possible to utilize combinations of monofunctional and polyfunctional polymer precursors, so long as the resulting cured matrix exhibits a sufficient degree of three-dimensional bonding to resist melting, softening, or chemical degradation as a result of the imaging process.

Polymers that are not highly crosslinked (such as the polyester film frequently used as an ink-accepting surface in lithographic plates), by contrast, are typically thermoplastic in nature, exhibiting a measurable glass-transition temperature $T_g$ at which they begin to soften, melting as the temperature increases further. Although replaced as printing surfaces by the highly crosslinked layer in accordance with the present invention, thermoplastic materials may underlie the highly crosslinked layer to impart useful mechanical properties (e.g., to limit the necessary thickness of the highly crosslinked layer) or to serve as a platform on which the highly crosslinked layer is synthesized and/or cured.

Suitable polymers useful as highly crosslinked layers include polyacrylates and polyurethanes. Suitable is polyacrylates include polyfunctional acrylates (i.e., based on monomers each containing more than one acrylate group) and mixtures of monofunctional and polyfunctional acrylates.

Alternatives to highly crosslinked polymers are possible. The ink-accepting surface may be any material that exhibits the necessary oleophilicity and resistance to thermal breakdown, as well as low heat conductivity (to avoid dissipating energy from the overlying imaging layer). Ceramic materials, for example, can fulfill these criteria.

In a second aspect, the invention alters the character of the debris rather than the surface it may compromise. An intervening layer, disposed between the imaging layer and the surface layer, prevents the surface layer from undergoing significant thermal degradation in response to imaging radiation or ablation of the underlying imaging layer, and is also formulated to produce debris having an affinity for ink and/or fountain solution similar to the affinity of the substrate—e.g., which does not reduce the oleophilicity of the underlying ink-accepting surface. Following imaging, the remnants of the insulating layer are removed along with the surface layer where the plate received imaging radiation.

In one preferred approach, the insulating layer is a polysilane—i.e., a silicon-based material in which substituted or unsubstituted silicon atoms are bonded directly to one another in long chains. Such materials not only produce debris likely to exhibit oleophilicity, but also adhere quite well to the polymeric, metal or inorganic materials that may be used as imaging layers. Accordingly, they may be applied to the imaging layer in any of a variety of ways, including, most preferably, by deposition under vacuum followed by curing.

In another approach, the insulating layer is chosen not for the character of its debris or for its resistance to producing debris, but for assisting with removal of an overlying layer following imaging. This type of layer desirably incorporates functional groups that assist with removal following imaging. For example, the insulating layer may be an acrylate layer with hydrophilic functional groups, which render exposed portions of the insulating layer interactive with an aqueous cleaning fluid. Alternatively, the insulating layer may be hydrophilic; for example, hydroxyethylcellulose or polyvinyl alcohol chemical species adhere well to metal and silicone layers.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
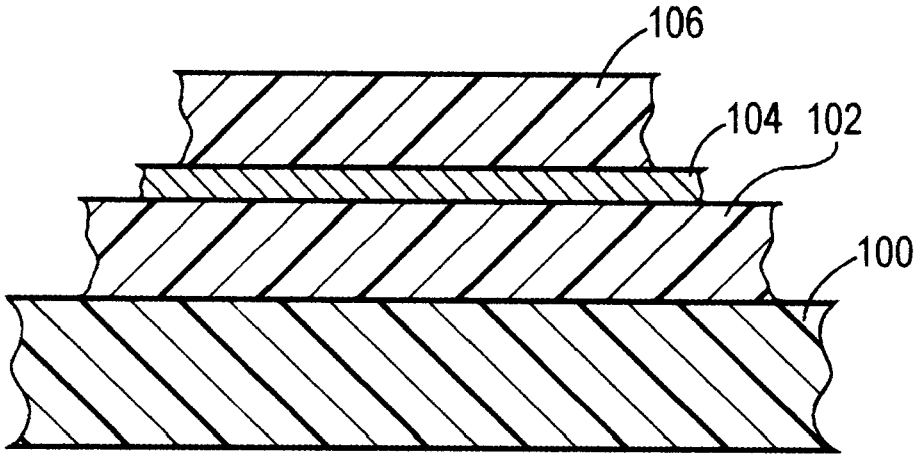
FIG. 1 is an enlarged sectional view of a lithographic plate having a silicone topmost layer, a metal or metal-containing imaging layer, an ink-accepting insulating layer, and a substrate.

Imaging apparatus suitable for use in conjunction with the present printing members includes at least one laser device that emits in the region of maximum plate responsiveness, i.e., whose $lambda_{max}$ closely approximates the wavelength region where the plate absorbs most strongly. Specifications for lasers that emit in the near-IR region are fully described in the '737 and '512 patents (the entire disclosure of which is hereby incorporated by reference); lasers emitting in other regions of the electromagnetic spectrum are well-known to those skilled in the art.

Suitable imaging configurations are also set forth in detail in the '737 and '512 patents. Briefly, laser output can be provided directly to the plate surface via lenses or other beam-guiding components, or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid plate movement (e.g., through use of high-speed motors) and thereby utilize high laser pulse rates, can frequently utilize a single laser as an imaging source.

Figure 2:
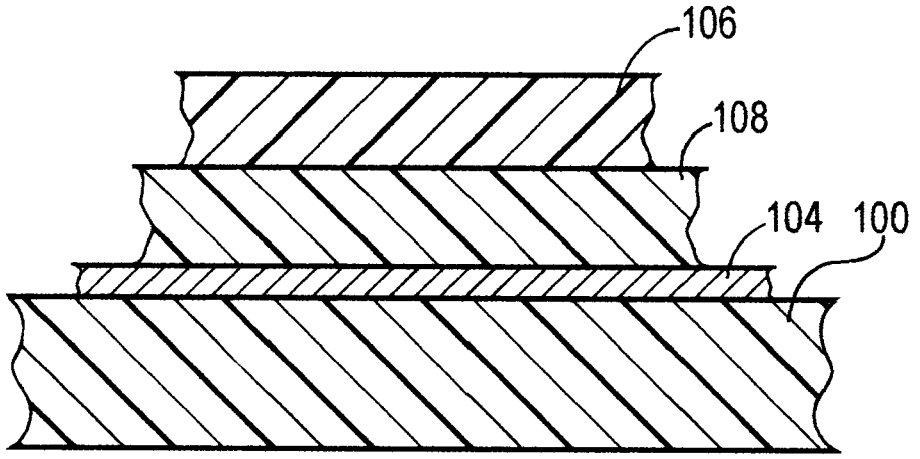
FIG. 2 is an enlarged sectional view of a lithographic plate having a silicone topmost layer, an insulating layer, a metal or metal-containing imaging layer, and a substrate.

Representative printing members in accordance with the present invention are illustrated in FIGS. 1 and 2. As used herein, the term "plate" or "member" refers to any type of printing member or surface capable of recording an image defined by regions exhibiting differential affinities for ink and/or fountain solution; suitable configurations include the traditional planar lithographic plates that are mounted on the plate cylinder of a printing press, but can also include cylinders (e.g., the roll surface of a plate cylinder), an endless belt, or other arrangement.

With reference to FIG. 1, a first printing member includes a substrate 100, an insulating layer 102, a radiation-absorptive imaging layer 104, and a surface layer 106.

Surface layer 106 is generally a silicone polymer or fluoropolymer that repels ink, while layer 102 is oleophilic and accepts ink. Layer 104 is generally a very thin layer of a metal. This layer ablates in response to imaging radiation.

The characteristics of substrate 100 depend on application. If rigidity and dimensional stability are important, substrate 100 can be a metal, e.g., a 5-mil aluminum sheet. Ideally, the aluminum is polished so as to reflect back into imaging layer 104 any radiation penetrating the overlying layers. Alternatively, layer 100 can be a polymer, as illustrated, such as a polyester film; once again, the thickness of the film is determined largely by the application. The benefits of reflectivity can be retained in connection with a polymeric substrate 100 by using a material containing a pigment that reflects imaging (e.g., IR) radiation. A material suitable for use as an IR-reflective substrate 100 is the white 329 film supplied by ICI Films, Wilmington, Del., which utilizes IR-reflective barium sulfate as the white pigment. A preferred thickness is 0.007 inch. Finally, a polymeric substrate 100 can, if desired, be laminated to a metal support (not shown), in which case a thickness of 0.002 inch is preferred. As disclosed in U.S. Pat. No. 5,570,636, the entire disclosure of which is hereby incorporated by reference, the metal support or the laminating adhesive can reflect imaging radiation.

Layer 102 maintains chemical and physical integrity notwithstanding the effects of imaging radiation and ablation of the overlying layer 104. Preferably, layer 102 is a highly crosslinked polymer exhibiting substantial resistance to heat. However, other refractory, heat-resistant, oleophilic materials such as ceramics can instead serve as layer 102. The choice of material is generally dictated by considerations relating to application technique, economics, and maximum desired thickness.

For example, as discussed below, layer 104 is desirably applied by deposition under vacuum conditions. Accordingly, materials amenable to vacuum deposition may be preferred for layer 102, allowing consecutive layers to be built up in multiple depositions within the same chamber or a linked series of chambers under common vacuum. One suitable approach is detailed in U.S. Pat. Nos. 5,440,446, 4,954,371, 4,696,719, 4,490,774, 4,647,818, 4,842,893, and 5,032,461, the entire disclosures of which is hereby incorporated by reference. In accordance with those patents, an acrylate monomer is applied as a vapor, under vacuum. For example, the monomer may be flash evaporated and injected into a vacuum chamber, where it condenses onto the surface. The monomer is then crosslinked by exposure to actinic (generally ultraviolet, or UV) radiation or an electron-beam (EB) source.

A related approach is described in U.S. Pat. No. 5,260,095, the entire disclosure of which is also incorporated by reference. In accordance with this patent, an acrylate monomer may be spread or coated onto a surface under vacuum, rather than condensed from a vapor. Again, following is application, the monomer is crosslinked by UV or EB exposure.

Either of these approaches may be used to apply layer 102 onto substrate 100. Moreover, their applicability is not limited to monomers; oligomers or larger polymer fragments or precursors can be applied in accordance with either technique, and subsequently crosslinked. Useful acrylate materials include conventional monomers and oligomers (monoacrylates, diacrylates, methacrylates, etc.), as described at cols. 8–10 of the '446 patent, as well as acrylates chemically tailored for particular applications. Representative monoacrylates include isodecyl acrylate, lauryl acrylate, tridecyl acrylate, caprolactone acrylate, ethoxylated nonyl phenyl acrylate, isobornyl acrylate, tripropylene glycol methyl ether monoacrylate, and neopentyl glycol propoxylate methylether monoacrylate; useful diacrylates include 1,6-hexaneciol diacrylate, tripropylene glycol diacrylate, polyethylene glycol (200) diacrylate, tetraethylene glycol diacrylate, polyethylene glycol (400) diacrylate, polyethylene glycol (600) diacrylate, propoxylated neopentyl glycol diacrylate, the IRR-214 product supplied by UCB Radcure (aliphatic diacrylate monomer), propoxylated 1,6-hexanediol diacrylate, and ethoxylated 1,6-hexanediol diacrylate; and useful triacrylates include trimethylolpropane triacrylate (TMPTA) and ethoxylated TMPTA.

Finally, acrylate-functional or other suitable resin coatings can be applied onto substrate 100 in routine fashion (under atmospheric conditions), according to techniques well-known in the art, and subsequently cured. In one such approach, one or more acrylates are coated directly onto substrate 100 and cured. In another approach, one or more acrylates is combined with a solvent (or solvents) and cast onto substrate 100, following which the solvent is evaporated and the deposited acrylate cured. Volatile solvents, which promote highly uniform application at low coating weights, are preferred. Acrylate coatings can also include non-acrylate functional compounds soluble or dispersible into an acrylate.

Alternatives to acrylates include thermoset, isocyanate-based, aziridines, and epoxies. Thermoset reactions can involve, for example, an aminoplast resin with hydroxyl sites of the primary coating resin. These reactions are greatly accelerated by creation of an acid environment and the use of heat.

Isocyanate-based polymers include the polyurethanes. One typical approach involves two-part urethanes in which an isocyanate component reacts with hydroxyl sites on one or more "backbone" resins (often referred to as the "polyol" component). Typical polyols include polyethers, polyesters, and acrylics having two or more hydroxyl-functional sites. Important modifying resins include hydroxyl-functional vinyl resins and cellulose-ester resins. The isocyanate component will have two or more isocyanate groups and is either monomeric or oligomeric. The reactions ordinarily proceed at ambient temperatures, but can be accelerated using heat and selected catalysts which include tin compounds and tertiary amines. The normal technique is to mix the isocynate-functional component(s) with the polyol component(s) just prior to use. The reactions begin, but are slow enough at ambient temperatures to allow a "pot life" during which the coating can be applied.

In another approach, the isocyanate is used in a "blocked" form in which the isocyanate component has been reacted with another component such as a phenol or a ketoxime to produce an inactive, metastable compound. This compound is designed for id decomposition at elevated temperatures to liberate the active isocyanate component which then reacts to cure the coating, the reaction being accelerated by incorporation of appropriate catalysts in the coating formulation.

Aziridines are frequently used to crosslink waterborne coatings based on carboxyl-functional resins. The carboxyl groups are incorporated into the resins to provide sites that form salts with water soluble amines, a reaction integral to the solubilizing or dispersing of the resin in water. The reaction proceeds at ambient temperatures after the water and solubilizing amine(s) have been evaporated upon deposition of the coating. The aziridines are added to the coating at the time of use and have a pot life governed by their rate of hydrolysis in water to produce inert by-products.

Epoxy reactions can be cured at elevated temperatures using, for example, a boron trifluoride complex, particularly for resins based on cycloaliphatic epoxy-functional groups. Another reaction is based on UV exposure-generated cationic catalysts.

Layer 104, which is generally applied as a vacuum-coated thin film, may be a metal or a mixture of metals. Titanium, either in pure form or as an alloy or an intermetallic, is preferred, although other metals such as aluminum can also be used to advantage. Titanium is particularly preferred for dry-plate constructions that utilize a silicone layer 106. Particularly where the silicone is cross-linked by addition cure, an underlying titanium layer offers substantial advantages over other metals. Coating an addition-cured is silicone over a titanium layer results in enhancement of catalytic action during cure, promoting substantially complete cross-linking; and may also promote further bonding reactions even after cross-linking is complete. These phenomena strengthen the silicone and its bond to the titanium layer, thereby enhancing plate life (since more fully cured silicones exhibit superior durability), and also provide resistance against the migration of ink-borne solvents through the silicone layer (where they can degrade underlying layers). Catalytic enhancement is especially useful where the desire for high-speed coating (or the need to run at reduced temperatures to avoid thermal damage to the ink-accepting support) make full cure on the coating apparatus impracticable; the presence of titanium will promote continued cross-linking despite temperature reduction.

Useful materials for layer 106 and techniques of coating are disclosed in the '737 and '512 patents. Basically, suitable silicone materials are applied using a wire-wound rod, then dried and heat-cured to produce a uniform coating deposited at, for example, 2 $g/m^2$.

Refer now to FIG. 2, which shows a second printing-member embodiment including a substrate 100, imaging layer 104 and surface layer 106 as described above, and also an insulating layer 108. In one version of this embodiment, layer 108 is a polysilane. As noted above, this type of material not only produces debris likely to exhibit oleophilicity, but also adheres quite well to layer 104. The polysilane may be applied to layer 104 by plasma polymerization, whereby a polymer precursor is introduced into a plasma under vacuum. The latter approach most often produces highly crosslinked, branched structures that include some siloxane content (so that the resulting product is most appropriately described as a random polysilane polysiloxane copolymer). So long as the polysiloxane content is sufficiently low, the resulting layer will accept ink.

Plasma-polymerized polysilanes are obtained by introducing silane precursors into a plasma created in an argon working gas. Suitable silane precursors include, for example, trimethylsilane, tetramethylsilane and trimethyldisilane. Depending on the conditions employed, resulting polymers will be extensively crosslinked and relatively free of oxygen (except at the top and bottom interfacial surfaces). Deposition generally occurs slowly, facilitating application of very thin (angstrom/nanometer scale) films. Plasma-polymerization working pressures are typically in the 0.1–0.01 torr range.

Polysilanes can also be applied as coatings or cast from solvents. Suitable solvent-borne polysilanes include the PS101 (poly(cyclohexylmethyl)silane), PS101.5 (polydihexylsilane), PS106 (poly(phenylmethylsilane)), PS109 (cyclohexylmethylsilane dimethylsilane copolymer), and PS110 (dimethylsilane phenylmethylsilane copolymer) products supplied by Huls America, Bristol, Pa. Other suitable polysilanes and their synthesis are described in U.S. Pat. Nos. 4,992,520, 5,039,593, 4,987,202, 4,588,801, and 4,587,205, and in Zeigler et al., "Self-developing polysilane deep-UV resists—photochemistry, photophysics, and submicron lithography," *SPIE Advances in Resist Technology and Processing II* 539:166–174 (1985). Generally, suitable applied polysilanes have molecular weights in excess of 1000 daltons.

In some applications it is desirable to incorporate functional groups into the polysilane in order to enhance adhesion with an overlying layer. For example, vinyl functional groups in layer 108 will bond with complementary groups in an addition-cure silicone layer 106 applied thereover and cured thereon. Thus, it is possible to use a polysilane/polysiloxane copolymer with substituted polysiloxane is groups at sufficiently low levels (e.g., 2% or less) to avoid ink repulsion.

In another version of this embodiment, layer 108 is chosen for its resistance to generating debris but having functional groups that assist with removability following imaging; that is, application of an imaging pulse will ablate layer 104 within the imaged region, but will likely cause only minor damage to layer 108 (as described below) and layer 106. These layers are rendered removable, however, by virtue of their deanchorage from substrate 100. That removal may be accomplished by mechanical action in the presence of a cleaning fluid, and chemical compatibility between that fluid and functional groups of the layer 108 polymer assists with its removal in imaged areas; so long as the materials are chosen so as to exhibit adequate interlayer adhesion, this compatibility will not cause damage to the unimaged areas during cleaning.

If the cleaning fluid is aqueous in nature, layer 108 may be a polyvinyl alcohol. These materials exhibit superior adhesion both to a silicone layer 106 and to a titanium-based layer 104. Moreover, polyvinyl alcohol layers cast from water are not affected by most press solvents, resulting in excellent plate durability during use. Suitable polyvinyl alcohol materials include the AIRVOL polymer products (e.g., AIRVOL 125 or AIRVOL 165, highly hydrolized polyvinyl alcohols supplied by Air Products, Allentown, Pa.). The polyvinyl alcohol may be coated onto substrate 100 by combining it with a large excess of water (e.g., at a 98:2 ratio, w/w) and applying the mixture with a wire-wound rod, following which the coating is dried for 1 min at 300° F. in a lab convection oven. An application weight of 0.2–0.5 g/m$^2$ is typical.

An alternative to polyvinyl alcohol is hydroxycellulose, e.g., the NATROSOL non-ionic, water-soluble polymers marketed by Aqualon Co., Houston, Tex. This material is a hydroxyethyl ether of cellulose. A 2% solution in water of the NATROSOL 250JR product was applied to a titanium-coated polyester substrate at 0.2 g/m$^2$, and dried for 1 min at 300° F. in a lab convection oven. This was coated with silicone at 2.0 g/m$^2$ to produce a water-cleanable dry plate.

In another approach, layer 108 is an acrylate material incorporating hydrophilic functional groups that render it compatible with (and removable by) an aqueous cleaning fluid. Hydrophilic groups that may be bound to or within acrylate monomers or oligomers include pendant phosphoric acid and ethylene oxide substitution. Preferred materials include the β-carboxyethyl acrylate; the polyethylene glycol diacrylates discussed above; the EB-170 product, a phosphoric acid-functional acrylate supplied by UCB Radcure, Inc., Atlanta, Ga.; and the PHOTOMER 4152 (pendant hydroxy), 4155 and 4158 (high ethoxy content), and 6173 (pendant carboxy) products supplied by Henkel.

Alternatively, hydrophilic compounds may be included as non-reactive components in the coating mixture, which become entrained within the resulting cured matrix and present hydrophilic sites that confer water wettability to the coating. Such compounds include polyethylene glycols and trimethylol propane. Particularly when applied by coating (as opposed to vacuum deposition), the range of non-acrylate, hydrophilic organic materials that can be added to an acrylate mixture is substantial, since molecular weight is not a significant consideration. Essentially, all that is required is solubility or miscibility in the acrylate base coating. Acrylic copolymers (including polyacrylic acid polymers) having high acrylic acid content are also possible. Non-vacuum applications also facilitate use of solid filler materials, particularly inorganics (such as silicas) to promote interactions with water-based cleaning solutions. Such fillers can be hydrophilic and/or can introduce porosity (texture), such as that obtained with conductive carbon blacks (e.g., the Vulcan XC-72 pigment supplied by the Special Blacks Division of Cabot Corp., Waltham, Mass.).

T-resins and ladder polymers represent still another class of material that can serve either as layer 108 in the second embodiment or as layer 102 in the first embodiment. These materials can be coated from a solvent and, particularly when phenyl-substituted, exhibit very high heat resistance. T-resins are highly crosslinked materials with the empirical formula $RSiO_{1.5}$. Ladder polymers may exhibit the structure

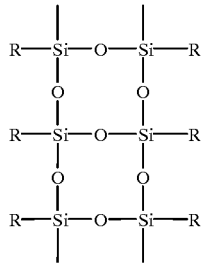

Both of these types of materials accept ink, and can be rendered hydrophilic (by using, for example, silanol substitution where R is —OH) or reactive with an overlying layer (by using, for example, vinyl substitution where R is —CH=CH$_2$). Furthermore, these materials tend to degrade to $SiO_{2-x}$ glasses rather than low molecular-weight siloxanes.

Suitable materials include, for example, polymethylsilsesquioxane, polyphenylpropylsilsesquioxane (which may be hydroxyl-substituted) and polyphenyl-vinylsilsesquioxane.

Figure 3A:
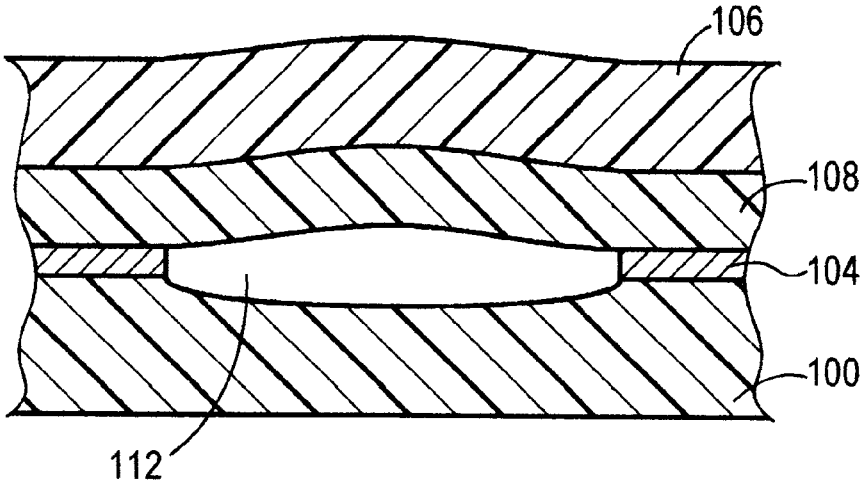
FIG. 3A illustrates the effect of imaging the plate shown in FIG. 2.
Figure 3B:
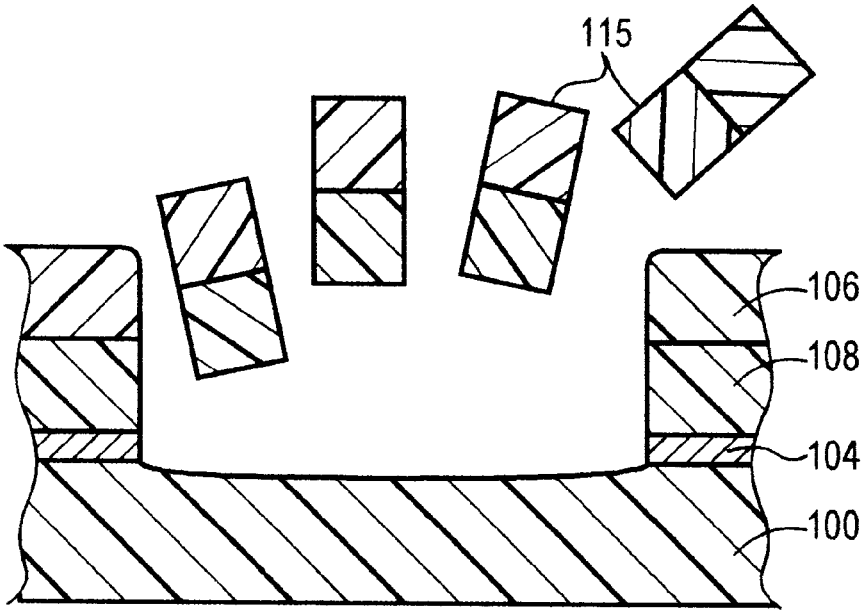
FIG. 3B illustrates the effect of cleaning the imaged plate with a water-based fluid.

The effect of imaging a plate in accordance with FIG. 2 is shown in FIG. 3A. The imaging pulse ablates layer 104 in the region of exposure, leaving a deanchorage void 112 between layers 100, 108 that renders overlying layers 106, 108 amenable to removal by cleaning. That process, illustrated in FIG. 3B, is enhanced by the hydrophilicity of layer 108. With application of an aqueous cleaning fluid, the deanchored regions of layers 106, 108 break up into a series of fragments 115 that are drawn into the cleaning fluid and removed, leaving layer 100 exposed where the imaging pulse struck.

An exemplary aqueous cleaning fluid for use with printing members having a hydrophilic layer 108 is prepared by combining tap water (11.4 L), Simple Green concentrated cleaner, supplied by Sunshine Makers, Inc., Huntington Beach, Calif. (150 ml), and one capful of the Super Defoamer 225 product supplied by Varn Products Company, Oakland, N.J. This material may be applied to is a rotating brush in contact with surface 106 following imaging, as described in U.S. Pat. No. 5,148,746, the entire disclosure of which is hereby incorporated by reference.

It will therefore be seen that the foregoing techniques and constructions result in lithographic printing plates with superior printing and performance characteristics. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member having a printing surface and including a first solid layer, a second solid layer underlying the first layer, a three-dimensionally crosslinked, heat-resistant polymeric layer underlying the second layer, and a polymeric substrate underlying the heat-resistant layer, the first layer and the heat-resistant layer having different affinities for ink, the second layer, but not the first layer, being formed of a material subject to ablative absorption of imaging radiation;

b. selectively exposing, in a pattern representing an image, the printing surface to laser radiation so as to ablate the second layer without causing the heat-resistant layer to undergo physical transformation, thereby avoiding entrapment of debris from an overlying layer; and c. removing remnants of the first and second layers where the printing member received radiation.

2. The method of claim 1 wherein the second layer of the printing member is metal.

3. The method of claim 2 wherein the metal comprises titanium.

4. The method of claim 1 wherein the heat-resistant layer is a polyacrylate.

5. The method of claim 4 wherein the polyacrylate is a polyfunctional acrylate.

6. The method of claim 4 wherein the polyacrylate is a mixture of monofunctional and polyfunctional acrylates applied by vapor deposition and then cured.

7. The method of claim 1 wherein the heat-resistant layer is a ladder polymer.

8. A lithographic printing member comprising:

a. a first solid layer;

b. a second solid layer underlying the first layer;

c. a three-dimensionally crosslinked, heat-resistant polymeric layer underlying the second layer; and d. a polymeric substrate underlying the heat-resistant layer, wherein e. the first layer and the heat-resistant layer have different affinities for ink;

f. the second layer, but not the first layer, is formed of a material subject to ablative absorption of imaging radiation; and g. the heat-resistant layer does not undergo physical transformation in response to imaging radiation.

9. The member of claim 8 wherein the second layer of the printing member is metal.

10. The member of claim 9 wherein the metal comprises titanium.

11. The member of claim 8 wherein the heat-resistant layer is a polyacrylate.

12. The member of claim 11 wherein the polyacrylate is a polyfunctional acrylate.

13. The member of claim 8 wherein the heat-resistant layer is a ladder polymer.

14. A method of imaging a lithographic printing member, the method comprising the steps of:

a. providing a printing member having a printing surface and including a first solid layer, a second solid layer underlying the first layer, and a heat-resistant layer underlying the second layer, the first layer and the heat-resistant layer having different affinities for ink, the second layer, but not the first layer, being formed of a material subject to ablative absorption of imaging radiation, the heat resistant layer being a T-resin;

b. selectively exposing, in a pattern representing an image, the printing surface to laser radiation so as to ablate the second layer without causing the heat-resistant layer to undergo physical transformation, thereby avoiding entrapment of debris from an overlying layer; and c. removing remnants of the first and second layers where the printing member received radiation.

15. A lithographic printing member comprising:

a. a first solid layer;

b. a second solid layer underlying the first layer; and c. a heat-resistant layer underlying the second layer, wherein d. the first layer and the heat-resistant layer have different affinities for ink;

e. the second layer, but not the first layer, is formed of a material subject to ablative absorption of imaging radiation; and f. the heat resistant layer is a T-resin and does not undergo physical transformation in response to imaging radiation.

* * * * *